US011156195B2

(12) United States Patent
George et al.

(10) Patent No.: US 11,156,195 B2
(45) Date of Patent: Oct. 26, 2021

(54) METHOD AND APPARATUS FOR ADJUSTABLE FUEL PRESSURE MODULE

(71) Applicant: Sinister Mfg. Company, Inc., Roseville, CA (US)

(72) Inventors: Brian George, Loomis, CA (US); Michael Mitchell, Loomis, CA (US)

(73) Assignee: Sinister Mfg. Company, Inc., Roseville, CA (US)

( * ) Notice: Subject to any disclaimer, the term of this patent is extended or adjusted under 35 U.S.C. 154(b) by 0 days.

(21) Appl. No.: 16/213,861

(22) Filed: Dec. 7, 2018

(65) Prior Publication Data

US 2019/0234360 A1 Aug. 1, 2019

Related U.S. Application Data

(60) Provisional application No. 62/596,048, filed on Dec. 7, 2017.

(51) Int. Cl.

| | |
|---|---|
| ***F02M 59/44*** | (2006.01) |
| ***F02M 63/02*** | (2006.01) |
| ***F02M 37/00*** | (2006.01) |
| ***F02D 41/38*** | (2006.01) |
| ***F02M 69/54*** | (2006.01) |

(52) U.S. Cl.

CPC ..... *F02M 59/44* (2013.01); *F02D 41/3845* (2013.01); *F02M 37/0029* (2013.01); *F02M 63/0225* (2013.01); *F02M 69/54* (2013.01); *F02D 2200/0602* (2013.01); *F02D 2250/31* (2013.01)

(58) Field of Classification Search

CPC .... F02M 69/54; F02M 59/44; F02M 37/0029; F02M 37/22; F02M 63/0225; Y10T 137/7836; F02D 41/3845; F02D 2200/0602

USPC ..... 123/457; 55/417; 210/741, 90, 416.4, 210/429, 6, 652

See application file for complete search history.

(56) References Cited

U.S. PATENT DOCUMENTS 4,653,528 A * 3/1987 Field ..... F02M 69/54 137/269
5,186,147 A * 2/1993 Bellis ..... F02M 37/0029 123/452
5,226,392 A * 7/1993 Breuer ..... F02M 69/54 123/457

(Continued)

*Primary Examiner* — Gonzalo Laguarda

(57) ABSTRACT

Method and apparatus for adjustable fuel pressure module. In accordance with an embodiment of the present invention, an apparatus for regulating fuel pressure comprises a body configured to mate to a fuel filter housing, a spring seat assembly configured to seal an opening in the fuel filter housing according to a force applied by a pressure regulating spring acting on the spring seat assembly, and a pressure regulating spring adjusting assembly mounted to the body, configured to constrain an adjustable length of the pressure regulating spring, wherein the spring is constrained between the spring seat assembly and the pressure regulating spring adjusting assembly. A force exerted upon the spring seat assembly by the pressure regulating spring corresponds to a desirable fuel pressure. The spring seat assembly is configured to unseal the opening in the fuel filter housing responsive to a fuel pressure greater than the desirable fuel pressure.

20 Claims, 17 Drawing Sheets

(56) References Cited

U.S. PATENT DOCUMENTS

| | | | | |
|---|---|---|---|---|
| 6,269,835 | B1 * | 8/2001 | Kochsmeier | F02M 37/22 137/549 |
| 6,422,265 | B1 * | 7/2002 | Beyer | F02M 69/54 123/463 |
| 6,446,939 | B1 * | 9/2002 | Hoppe | F02M 17/04 261/35 |
| 7,004,456 | B2 * | 2/2006 | Newman | B66D 1/58 166/77.51 |
| 8,939,736 | B2 * | 1/2015 | Israelson | F04D 5/002 417/310 |
| 9,188,092 | B2 * | 11/2015 | McAvey | F02M 37/0088 |
| 10,167,970 | B2 * | 1/2019 | Lee | F16K 17/048 |
| 2018/0274395 | A1 * | 9/2018 | Fawley | F01L 1/205 |

* cited by examiner

101

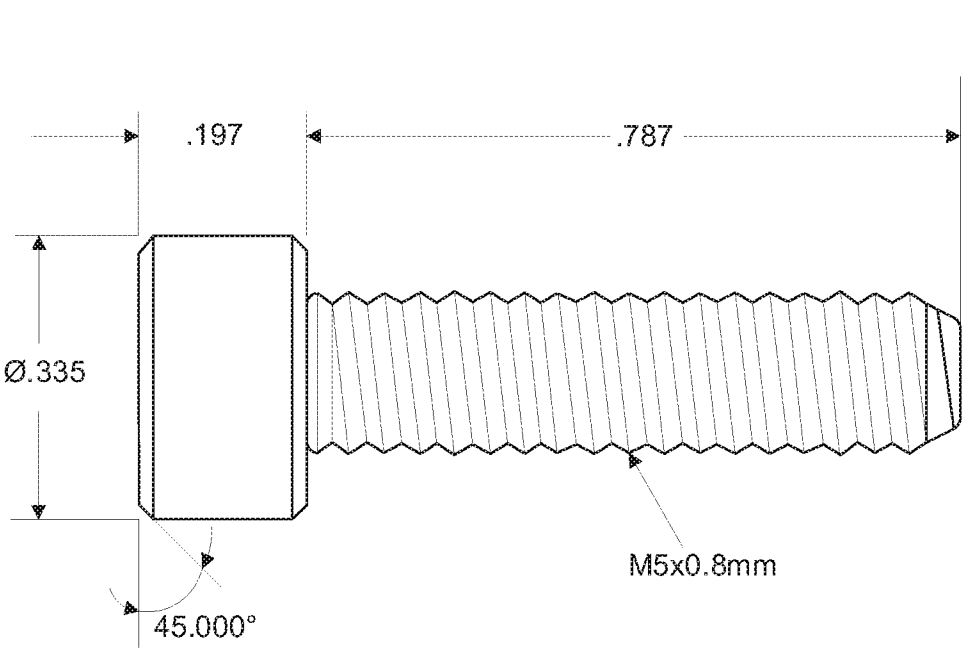
FIG. 13
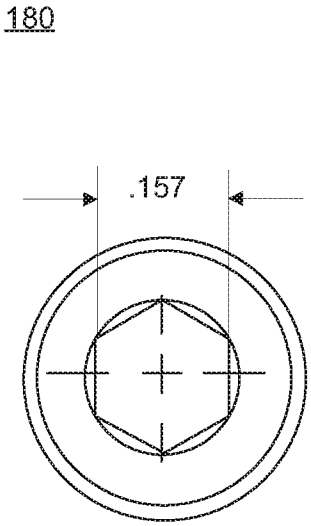
180

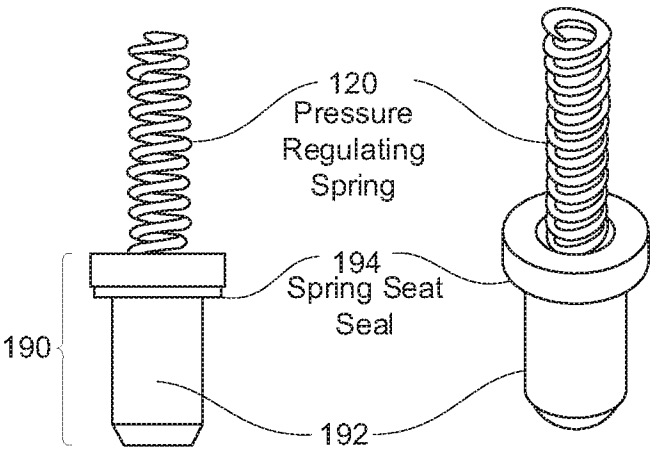
FIG. 14A
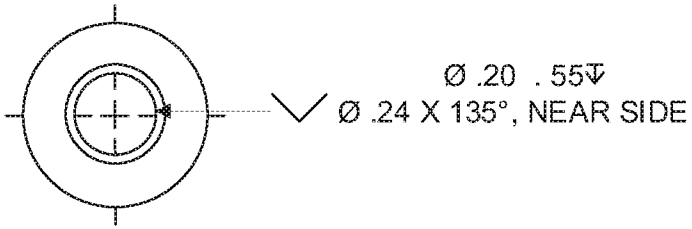
FIG. 14B
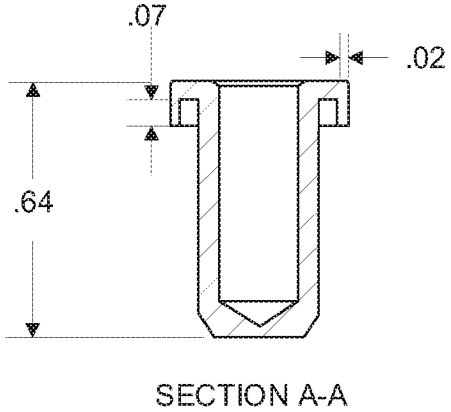
FIG. 14C
FIG. 14D
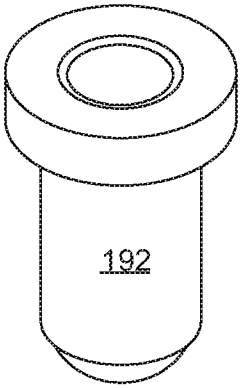
FIG. 14E
FIG. 14F

1710

1720

METHOD AND APPARATUS FOR ADJUSTABLE FUEL PRESSURE MODULE

RELATED APPLICATION

This application claims priority to U.S. Provisional Patent Application No. 62/596,048, filed Dec. 7, 2017, entitled "Method and Apparatus for Adjustable Fuel Pressure Module" to George and Mitchell, which is hereby incorporated herein by reference in its entirety.

FIELD OF INVENTION

Embodiments of the present invention relate to the field of engines, including internal combustion engines. More specifically, embodiments of the present invention relate to methods and apparatuses for adjustable fuel pressure modules.

BACKGROUND

In many engines, including fuel injected internal combustion engines, regulation of fuel pressure is a critical aspect of engine performance. A typical fuel pressure regulator may comprise a non-adjustable spring to regulate fuel pressure. Unfortunately, such a non-adjustable spring may provide a non-desirable fuel pressure for any particular engine, including differences due to manufacturing variation, under various engine operating conditions, and/or for any of myriad potential engine modifications. In addition, the force-displacement characteristic of such a spring may not produce an advantageous fuel pressure regulation throughout the spring's range of displacement. Further, a non-adjustable spring generally will degrade over time, resulting in an undesirable change to fuel pressure regulation.

SUMMARY OF THE INVENTION

Therefore, what is needed are methods and apparatuses for adjustable fuel pressure modules. What is additionally needed are methods and apparatuses for adjustable fuel pressure modules that are able to adjust fuel pressure to desirable levels. A further need is for methods and apparatuses for adjustable fuel pressure modules that are able to adjust fuel pressure to compensate for aging components. A still further need exists for methods and apparatuses for adjustable fuel pressure modules that are compatible and complementary with existing systems and methods of engine fuel pressure regulation. Embodiments of the present invention provide these advantages.

In accordance with a first method embodiment, a method of regulating fuel pressure includes sealing an opening in a fuel filter housing according to a force applied by a pressure regulating spring acting on a spring seat assembly, and adjusting the force applied by the pressure regulating spring to establish a desirable fuel pressure by changing a length of the pressure regulating spring by a screw action of a pressure regulating spring adjusting assembly constraining one end of the pressure regulating spring. The method also includes unsealing the opening in a fuel filter housing responsive to a fuel pressure within the fuel filter greater than the desirable fuel pressure.

In accordance with another embodiment of the present invention, an apparatus for regulating fuel pressure comprises a body configured to mate to a fuel filter housing, a spring seat assembly configured to seal an opening in the fuel filter housing according to a force applied by a pressure regulating spring acting on the spring seat assembly, and a pressure regulating spring adjusting assembly mounted to the body, configured to constrain an adjustable length of the pressure regulating spring, wherein the spring is constrained between the spring seat assembly and the pressure regulating spring adjusting assembly. A force exerted upon the spring seat assembly by the pressure regulating spring corresponds to a desirable fuel pressure. The spring seat assembly is configured to unseal the opening in the fuel filter housing responsive to a fuel pressure greater than the desirable fuel pressure.

In accordance with yet another embodiment of the present invention, a vehicle includes an engine for converting chemical energy of a fuel into mechanical energy to move the vehicle and an apparatus for regulating fuel pressure for the engine. The apparatus includes a body configured to mate to a fuel filter housing, a spring seat assembly configured to seal an opening in the fuel filter housing according to a force applied by a pressure regulating spring acting on the spring seat assembly, and a pressure regulating spring adjusting assembly mounted to the body, configured to constrain an adjustable length of the pressure regulating spring, wherein the spring is constrained between the spring seat assembly and the pressure regulating spring adjusting assembly. A force exerted upon the spring seat assembly by the pressure regulating spring corresponds to a desirable fuel pressure. The spring seat assembly is configured to unseal the opening in the fuel filter housing responsive to a fuel pressure greater than the desirable fuel pressure.

BRIEF DESCRIPTION OF THE DRAWINGS

The accompanying drawings, which are incorporated in and form a part of this specification, illustrate embodiments of the invention and, together with the description, serve to explain the principles of the invention. Unless otherwise noted, the drawings are not drawn to scale. All indicated dimensions are exemplary.

FIG. 13 illustrates an exemplary mounting bolt, in accordance with embodiments of the present invention.

FIG. 14A illustrates an exemplary spring seat seal assembly, in accordance with embodiments of the present invention.

FIG. 14B is a perspective view of spring seat seal assembly fitted onto a pressure regulating spring, in accordance with embodiments of the present invention.

FIG. 14C is a detail plan view of exemplary spring seat, in accordance with embodiments of the present invention.

FIG. 14D is a detail side view of exemplary spring seat, in accordance with embodiments of the present invention.

FIG. 14E is a side sectional view of exemplary spring seat, in accordance with embodiments of the present invention.

FIG. 14F is a perspective view of spring seat, in accordance with embodiments of the present invention.

DETAILED DESCRIPTION

Reference will now be made in detail to various embodiments of the present invention, examples of which are illustrated in the accompanying drawings. While the invention will be described in conjunction with these embodiments, it is understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the invention, numerous specific details are set forth in order to provide a thorough understanding of the invention. However, it will be recognized by one of ordinary skill in the art that the invention may be practiced without these specific details. In other instances, well known methods, procedures, components, circuits, and modules have not been described in detail as not to unnecessarily obscure aspects of the invention.

Method and Apparatus for Adjustable Fuel Pressure Module

Figures 1A, 1B:
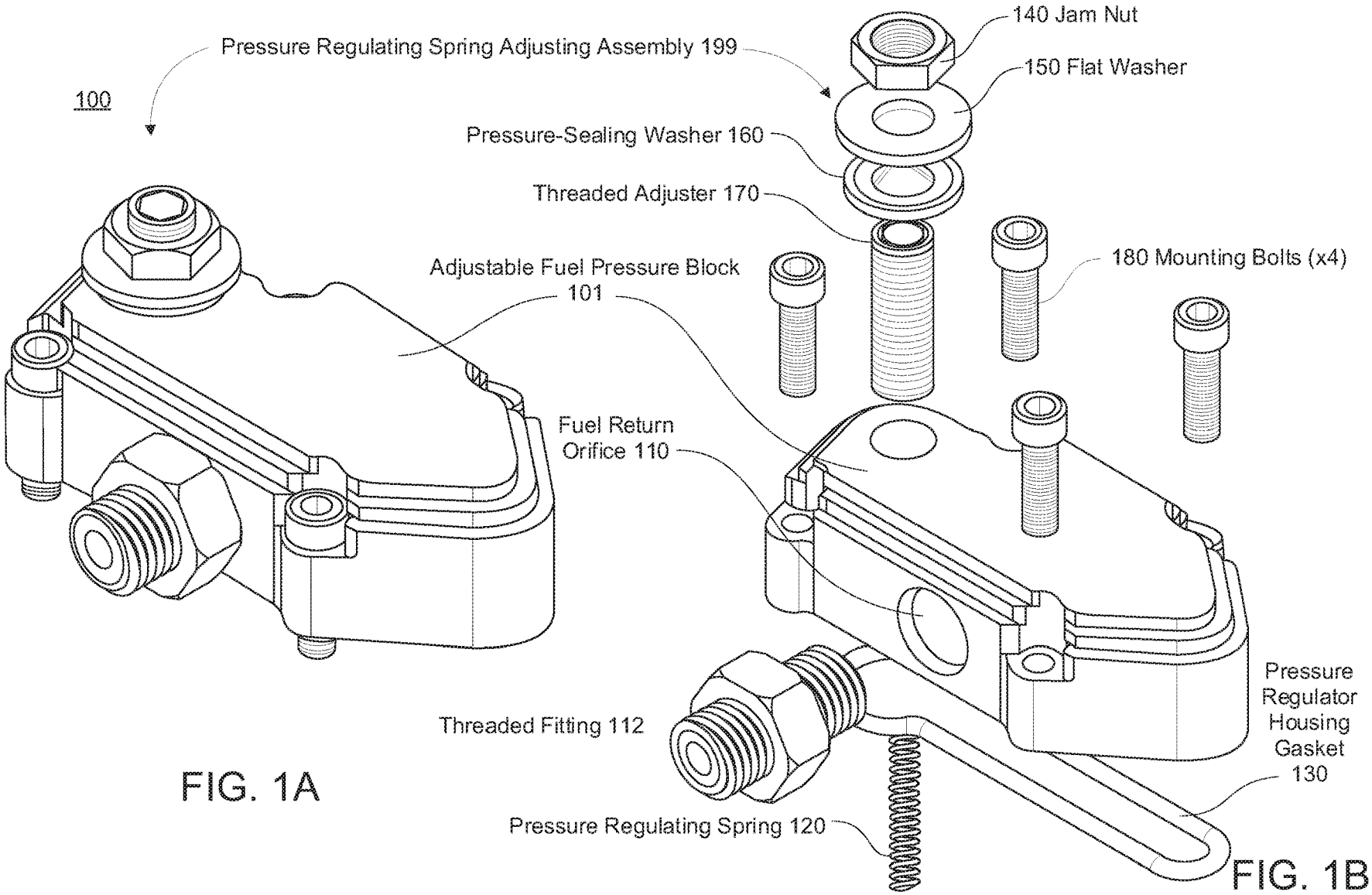
FIG. 1A illustrates an exemplary perspective view of an exemplary adjustable fuel pressure module, in accordance with embodiments of the present invention.
FIG. 1B illustrates an exemplary exploded perspective view of exemplary adjustable fuel pressure module, in accordance with embodiments of the present invention.

FIG. 1A illustrates an exemplary perspective view of an exemplary adjustable fuel pressure module 100, in accordance with embodiments of the present invention. FIG. 1B illustrates an exemplary exploded perspective view of exemplary adjustable fuel pressure module 100, in accordance with embodiments of the present invention. Adjustable fuel pressure module 100 is configured to be mounted to a fuel filter housing (not shown). The adjustable fuel pressure module 100 regulates the pressure of fuel delivered from a fuel filter (not shown) housed within the fuel filter housing to an engine (not shown), for example, to a fuel manifold of a diesel internal combustion engine.

Exemplary adjustable fuel pressure module 100 comprises an adjustable fuel pressure block 101. Adjustable fuel pressure block 101 may be machined from an aluminum billet, in some embodiments. It is to be appreciated that machined parts have different structural characteristics from parts manufactured by other processes. Such differences may include, for example, material grain alignment, finish, dimensional accuracy, including, for example, lack of "draft," and lack of undesirable artifacts of other manufacturing processes, including, for example, knit or weld lines, gate(s), flash, flow marks, mold seams, tool marks, and the like.

The adjustable fuel pressure module 100 may be mounted to a fuel filter housing via a plurality of mounting bolts 180. Pressure regulator housing gasket 130 functions to seal the adjustable fuel pressure module 100 to the fuel filter housing. Fuel may flow from the adjustable fuel pressure module 100 through fuel return orifice 110 and the threaded fitting 112 to a fuel tank (not shown) as part of a fuel-pressure regulating process.

Adjustable fuel pressure module 100 comprises a pressure regulating spring 120, and a pressure regulating spring adjusting assembly 199. The pressure regulating spring adjusting assembly 199 comprises a threaded adjuster 170, a pressure-sealing washer 160, a flat washer 150, and a jam nut 140. The threaded adjuster 170 mates with the adjustable fuel pressure block 101 via a threaded interface. The jam nut 140 may be threaded onto the threaded adjuster 170, and constrains the flat washer 150 and the pressure-sealing washer 160 against a face of the adjustable fuel pressure block 101. The pressure regulating spring adjusting assembly 199 constrains the pressure regulating spring 120 in compression along the longitudinal axis of the pressure regulating spring 120.

Figure 2:
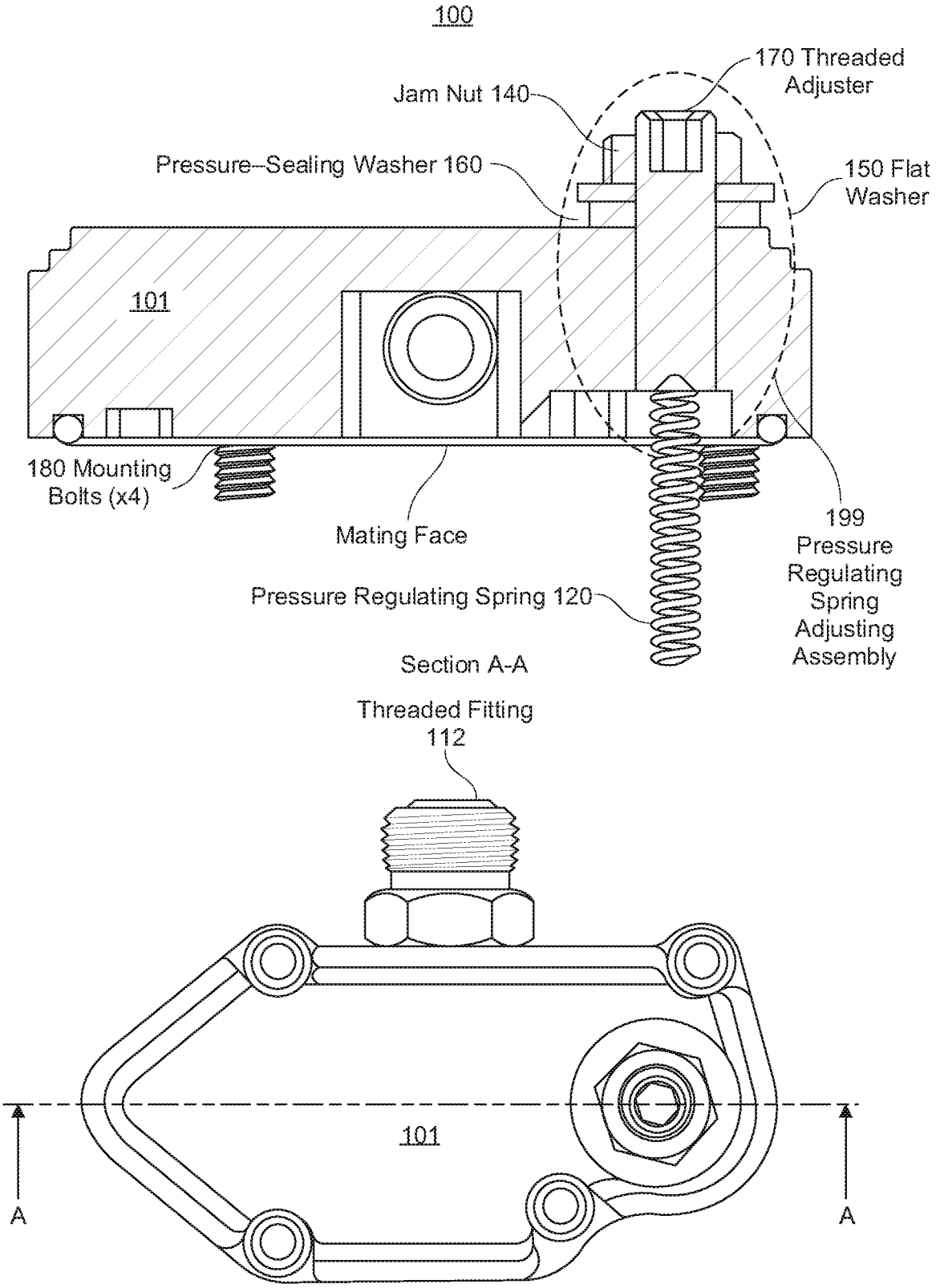
FIG. 2 illustrates a side sectional view of adjustable fuel pressure module, in accordance with embodiments of the present invention.

FIG. 2 illustrates a side sectional view, section A-A, of adjustable fuel pressure module 100, in accordance with embodiments of the present invention. The bottom of section A-A may be known as or referred to as a "mating face" of adjustable fuel pressure module 100. This mating face contacts the fuel filter housing (not shown).

Figure 3:
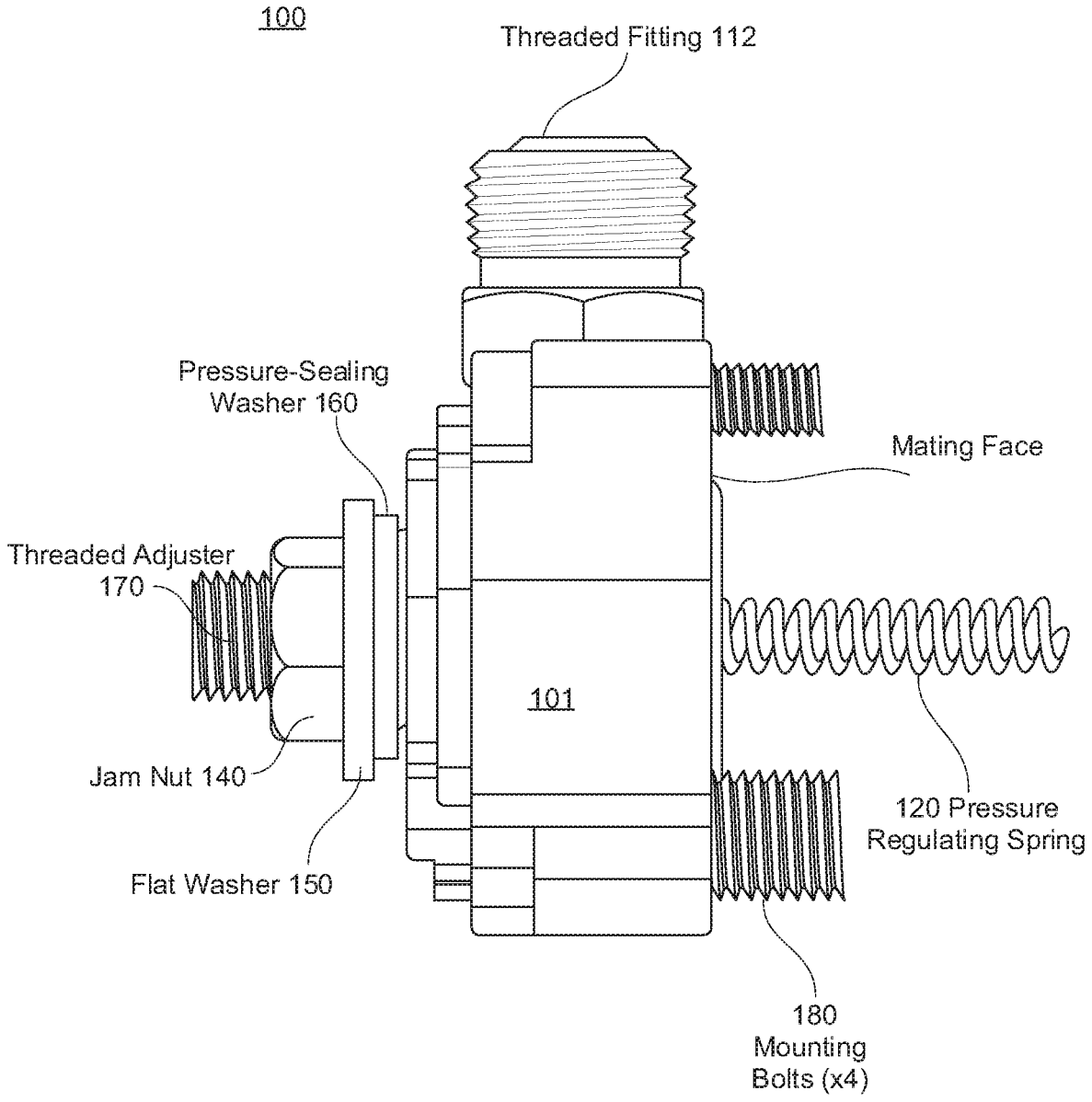
FIG. 3 illustrates a side view of adjustable fuel pressure module, in accordance with embodiments of the present invention.

FIG. 3 illustrates a side view of adjustable fuel pressure module 100, in accordance with embodiments of the present invention.

Figure 4:
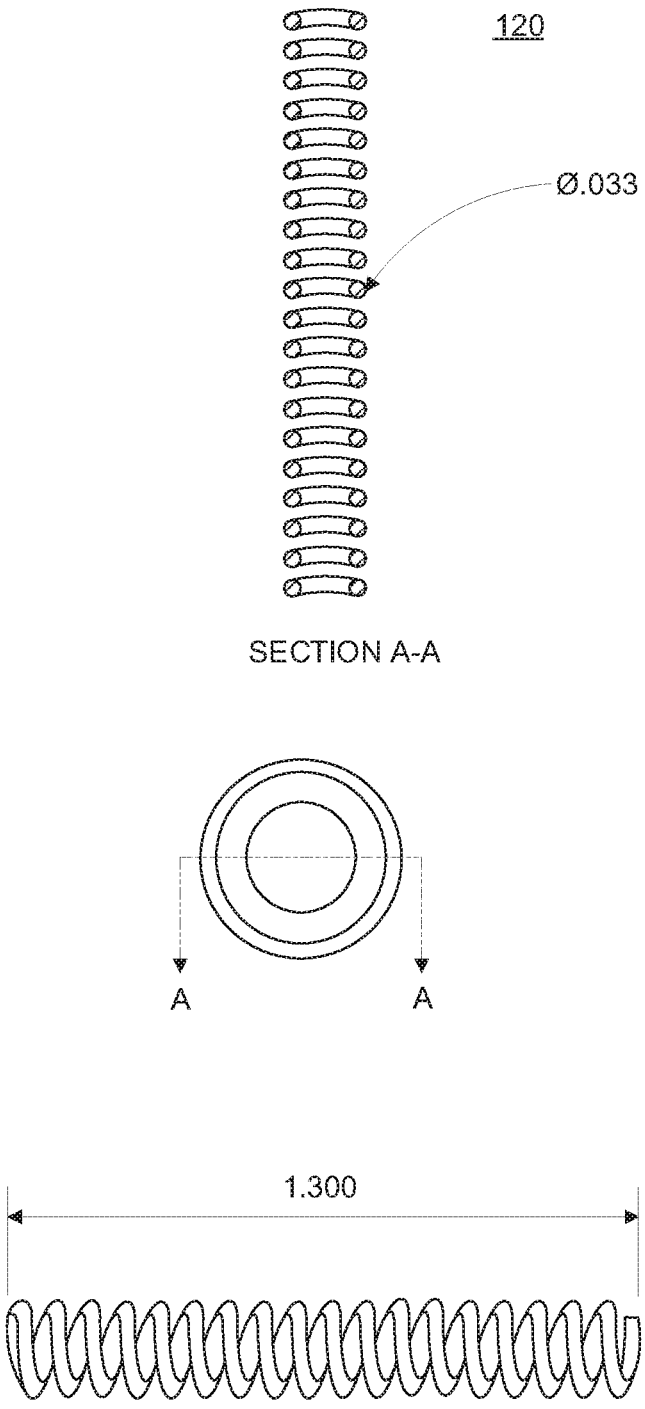
FIG. 4 illustrates an exemplary pressure regulating spring, in accordance with embodiments of the present invention.

FIG. 4 illustrates an exemplary pressure regulating spring 120, in accordance with embodiments of the present invention. In an exemplary embodiment, pressure regulating spring 120 may have 18 active coils, and the ends may be round and closed. The pressure regulating spring 120 may have a spring rate of 19 pounds/inch, in some embodiments.

Figure 5:
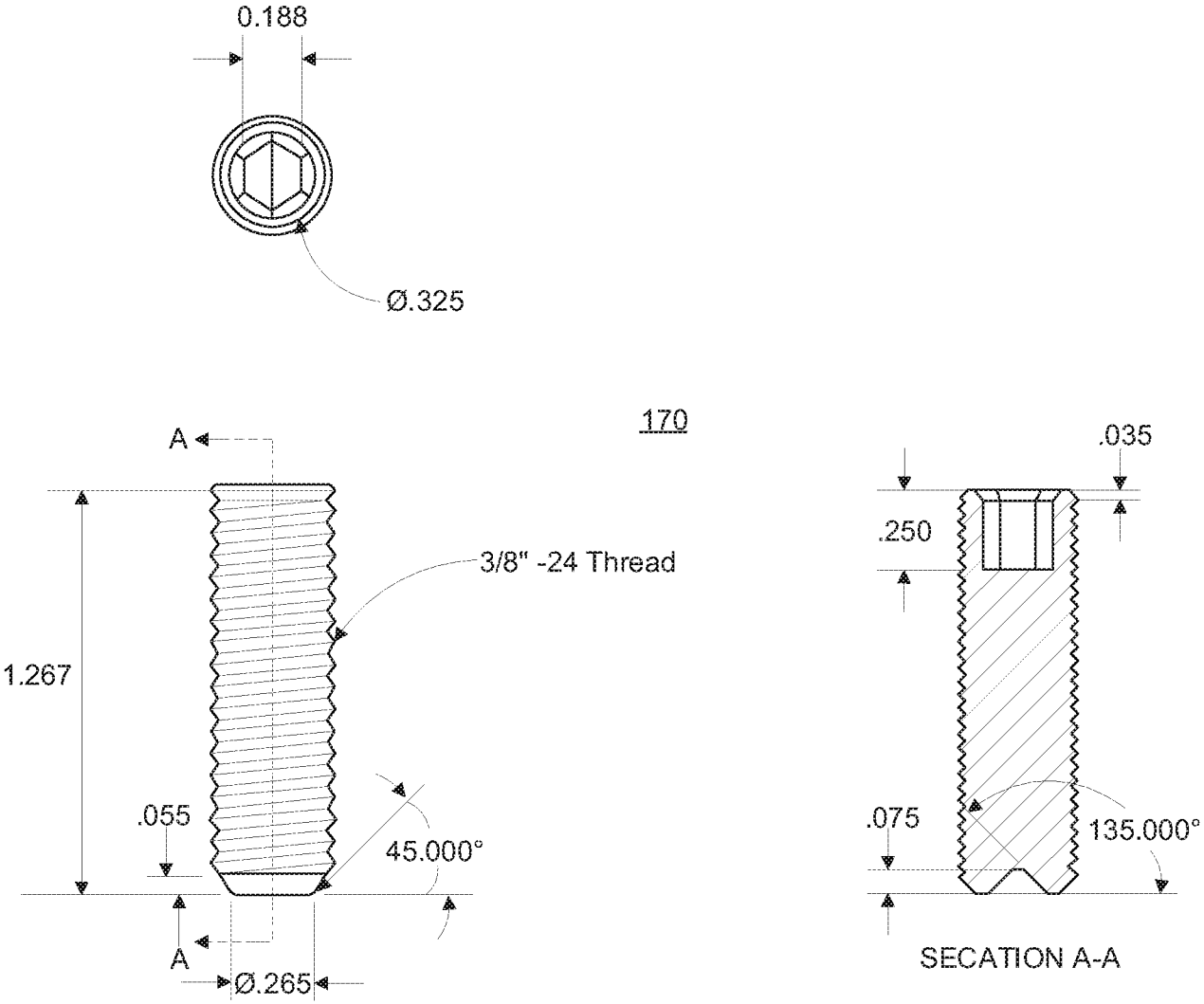
FIG. 5 illustrates an exemplary threaded adjustor, in accordance with embodiments of the present invention.

FIG. 5 illustrates an exemplary threaded adjustor 170, in accordance with embodiments of the present invention.

Figure 6:
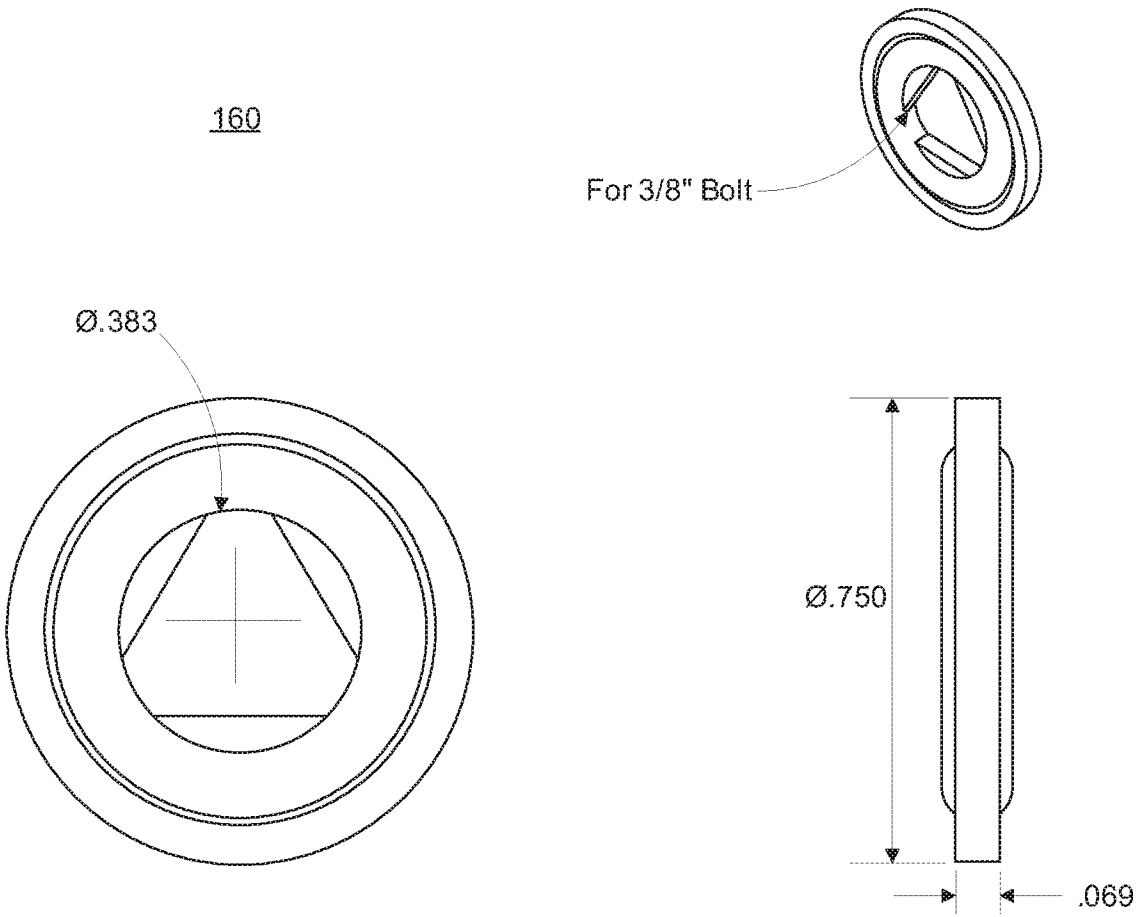
FIG. 6 illustrates an exemplary pressure-sealing washer, in accordance with embodiments of the present invention.

FIG. 6 illustrates an exemplary pressure-sealing washer 160, in accordance with embodiments of the present invention. As illustrated, e.g., in FIGS. 1B and 2, pressure-sealing washer 160 may be mounted on threaded adjustor 170.

Figure 7:
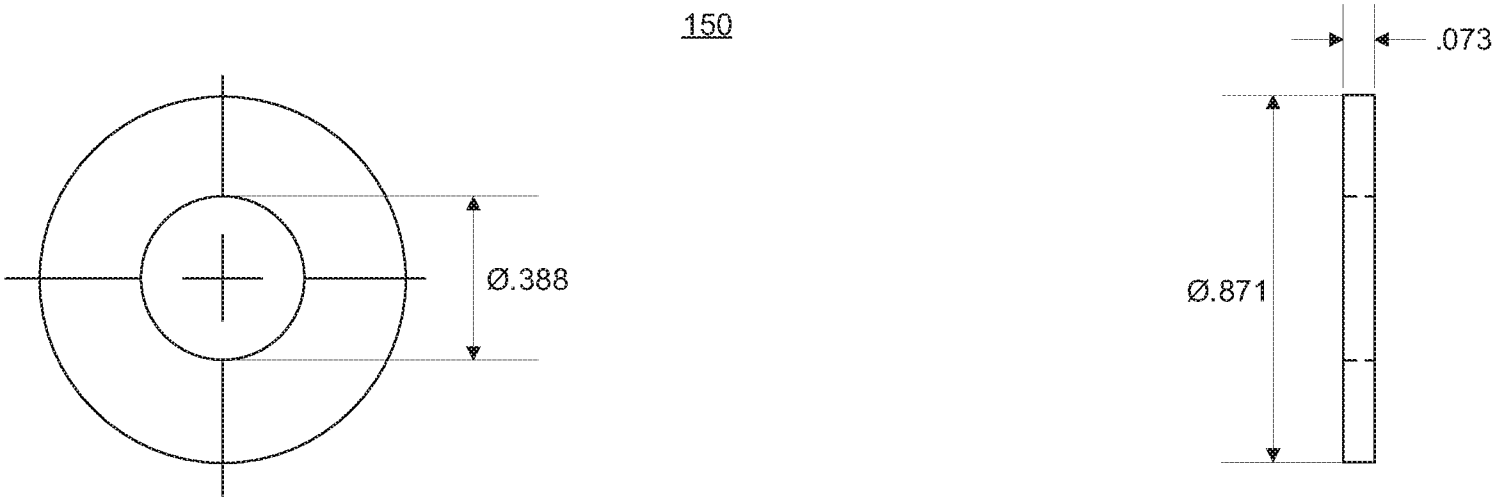
FIG. 7 illustrates an exemplary flat washer, in accordance with embodiments of the present invention.

FIG. 7 illustrates an exemplary flat washer 150, in accordance with embodiments of the present invention. As illustrated, e.g., in FIGS. 1B and 2, flat washer 150 may be mounted on threaded adjustor 170.

Figure 8:
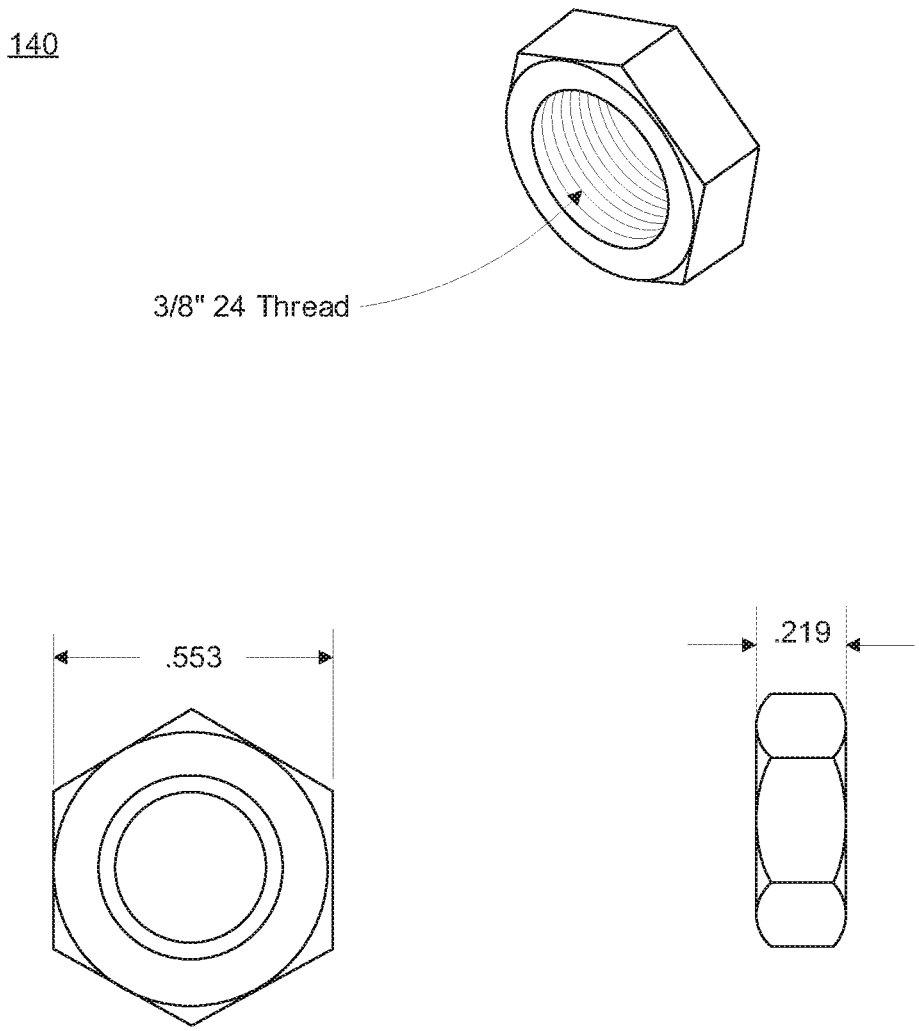
FIG. 8 illustrates an exemplary jam nut 140, in accordance with embodiments of the present invention.

FIG. 8 illustrates an exemplary jam nut 140, in accordance with embodiments of the present invention. As illustrated, e.g., in FIGS. 1B and 2, jam nut 140 may be mounted on threaded adjustor 170.

Figure 9:
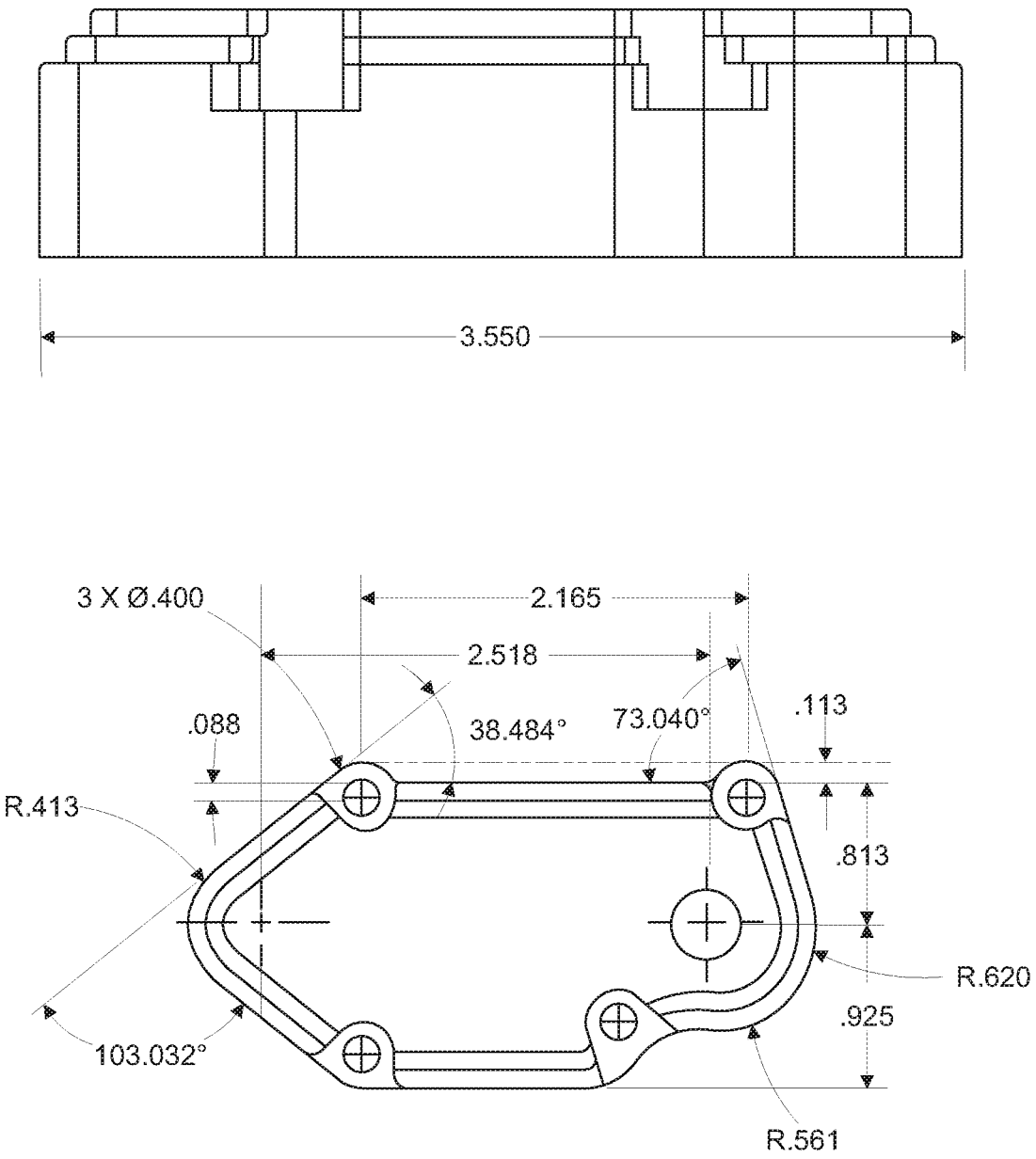
FIG. 9 illustrates a detail plan view of adjustable fuel pressure block, in accordance with embodiments of the present invention.

FIG. 9 illustrates a detail plan view of adjustable fuel pressure block 101, in accordance with embodiments of the present invention.

Figure 10B:
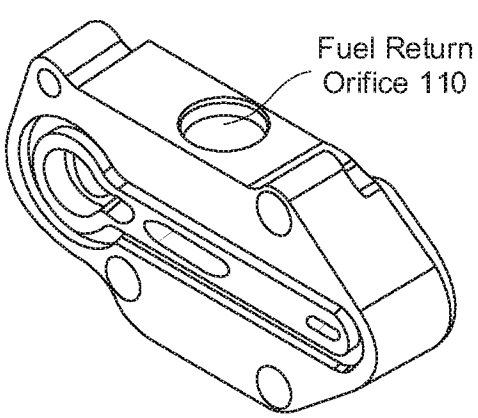
FIG. 10B illustrates a perspective view of the mating face of adjustable fuel pressure block, in accordance with embodiments of the present invention.
Figure 10A:
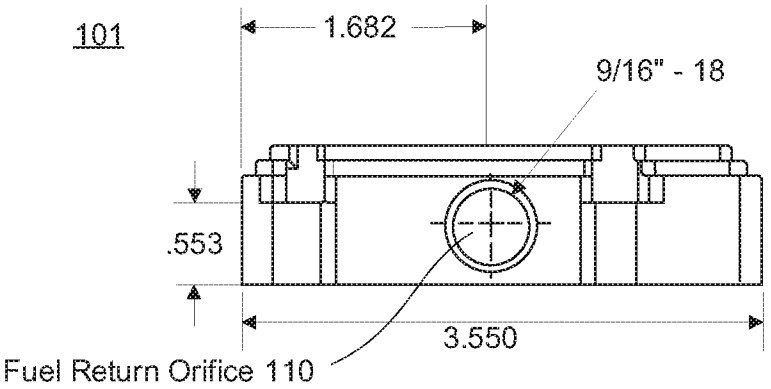
FIG. 10A illustrates a detail view of the fuel return orifice side of adjustable fuel pressure block, in accordance with embodiments of the present invention.

FIG. 10A illustrates a detail view of the fuel return orifice side of adjustable fuel pressure block 101, in accordance with embodiments of the present invention.

FIG. 10B illustrates a perspective view of the mating face of adjustable fuel pressure block 101, in accordance with embodiments of the present invention.

Figure 10D:
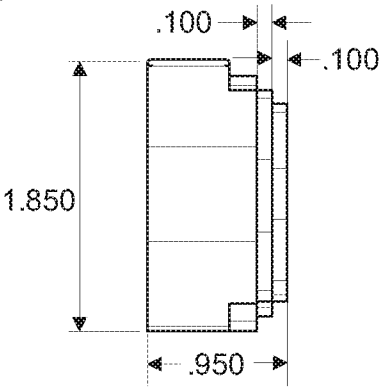
FIG. 10D illustrates a detail view of an end of adjustable fuel pressure block, in accordance with embodiments of the present invention.
Figure 10C:
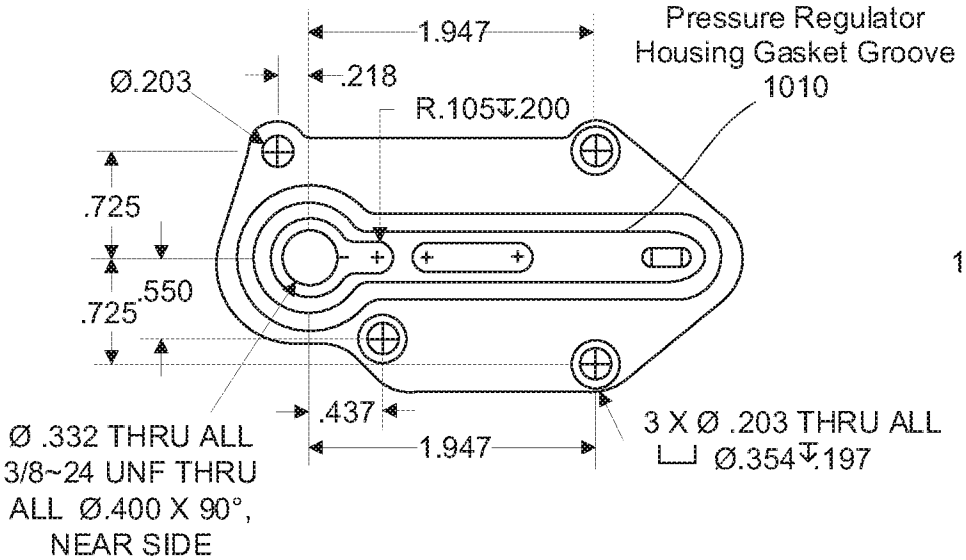
FIG. 10C illustrates a detail view of the mating face of adjustable fuel pressure block, in accordance with embodiments of the present invention.

FIG. 10C illustrates a detail view of the mating face of adjustable fuel pressure block 101, in accordance with embodiments of the present invention. FIG. 10C further illustrates pressure regulator housing gasket groove 1010, for accepting pressure regulator housing gasket 130 (FIG. 1B).

FIG. 10D illustrates a detail view of an end of adjustable fuel pressure block 101, in accordance with embodiments of the present invention.

Figure 11A:
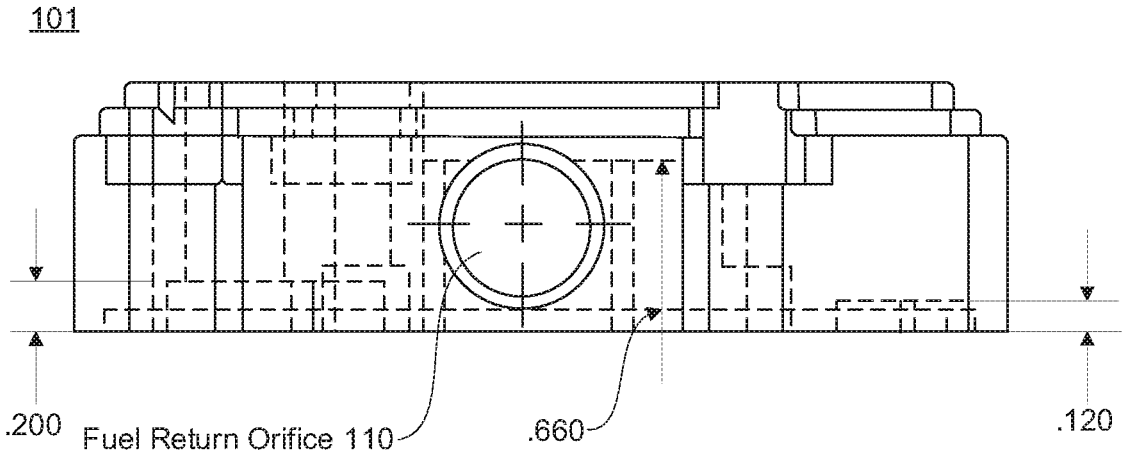
FIG. 11A illustrates additional details of the fuel return orifice side of adjustable fuel pressure block, in accordance with embodiments of the present invention.

FIG. 11A illustrates additional details of the fuel return orifice side of adjustable fuel pressure block 101, in accordance with embodiments of the present invention.

Figure 11B:
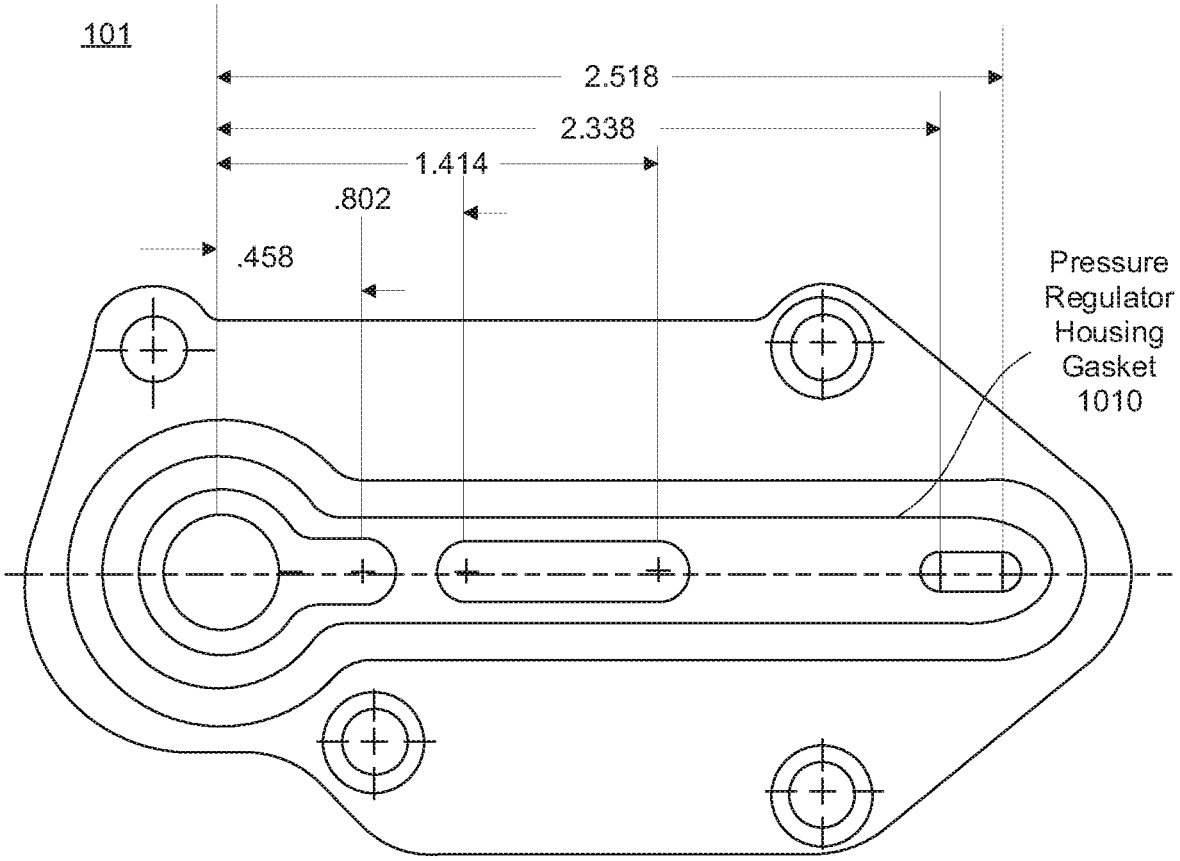
FIG. 11B illustrates additional details of the mating face of adjustable fuel pressure block, in accordance with embodiments of the present invention.

FIG. 11B illustrates additional details of the mating face of adjustable fuel pressure block 101, in accordance with embodiments of the present invention.

Figure 12:
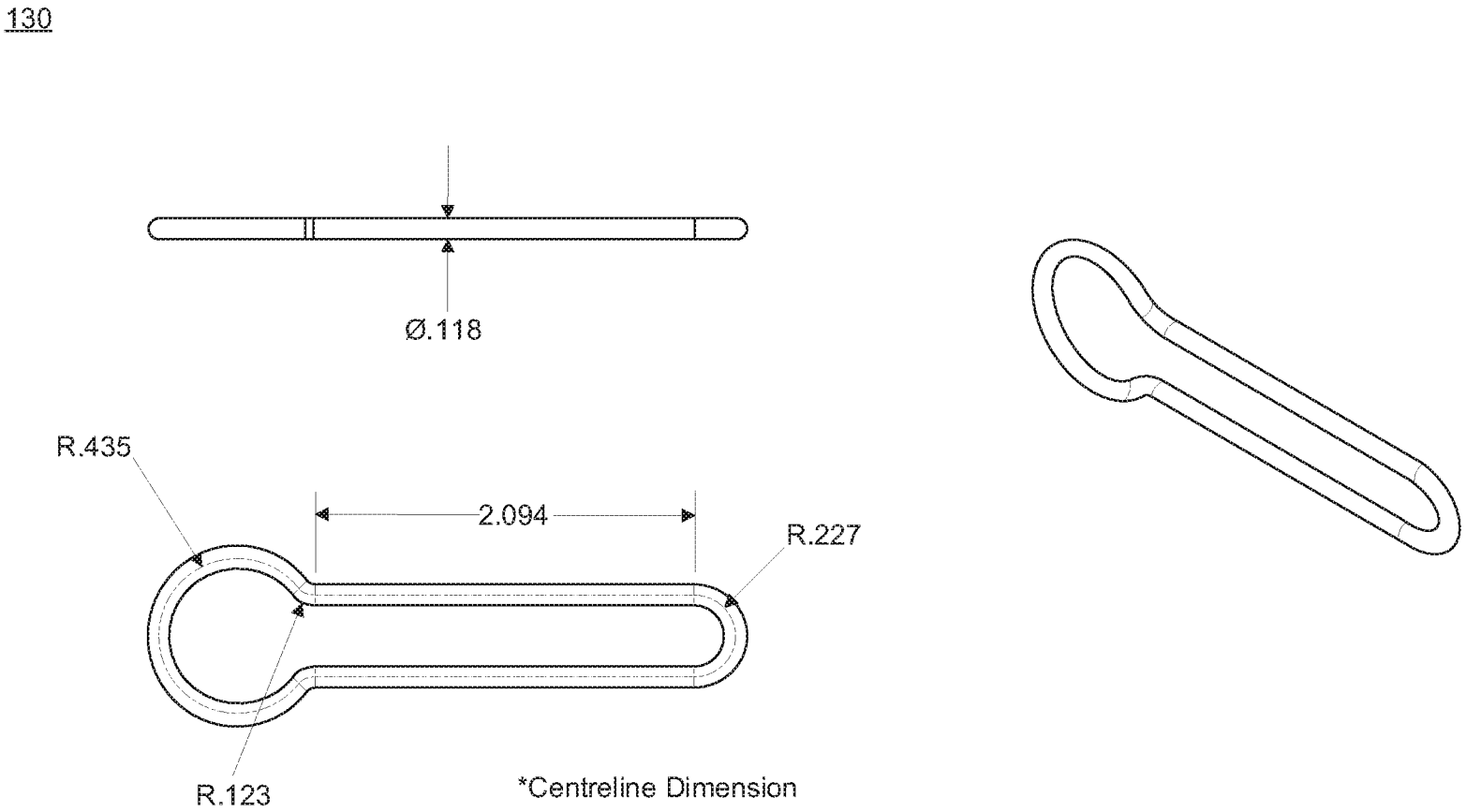
FIG. 12 illustrates an exemplary pressure regulator housing gasket, in accordance with embodiments of the present invention.

FIG. 12 illustrates an exemplary pressure regulator housing gasket 130, in accordance with embodiments of the present invention. Pressure regulator housing gasket 130 may be retained by pressure regulator housing gasket groove 1010 (FIG. 10C), and functions to seal the adjustable fuel pressure module 100 to a fuel filter housing (not shown).

FIG. 13 illustrates an exemplary mounting bolt 180, in accordance with embodiments of the present invention. A plurality of mounting bolts 180, e.g., 4, couple an adjustable fuel pressure module 100 to a fuel filter housing (not shown). In some embodiments, mounting bolt 180 may be known as or described as an "M5" bolt.

FIG. 14A illustrates an exemplary spring seat seal assembly 190, in accordance with embodiments of the present invention. The spring seat seal assembly 190 comprises a spring seat 192 and a spring seat seal 194. As illustrated, the spring seat seal assembly 190 fits over one end of the pressure regulating spring 120. The spring seat 192 may comprise brass, in some embodiments.

FIG. 14B is a perspective view of spring seat seal assembly 190 fitted onto pressure regulating spring 120, in accordance with embodiments of the present invention.

FIG. 14C is a detail plan view of exemplary spring seat 190, in accordance with embodiments of the present invention.

FIG. 14D is a detail side view of exemplary spring seat 190, in accordance with embodiments of the present invention.

FIG. 14E is a side sectional view of exemplary spring seat 190, along section A-A of FIG. 14D, in accordance with embodiments of the present invention.

FIG. 14F is a perspective view of spring seat 192, in accordance with embodiments of the present invention.

Figure 15:
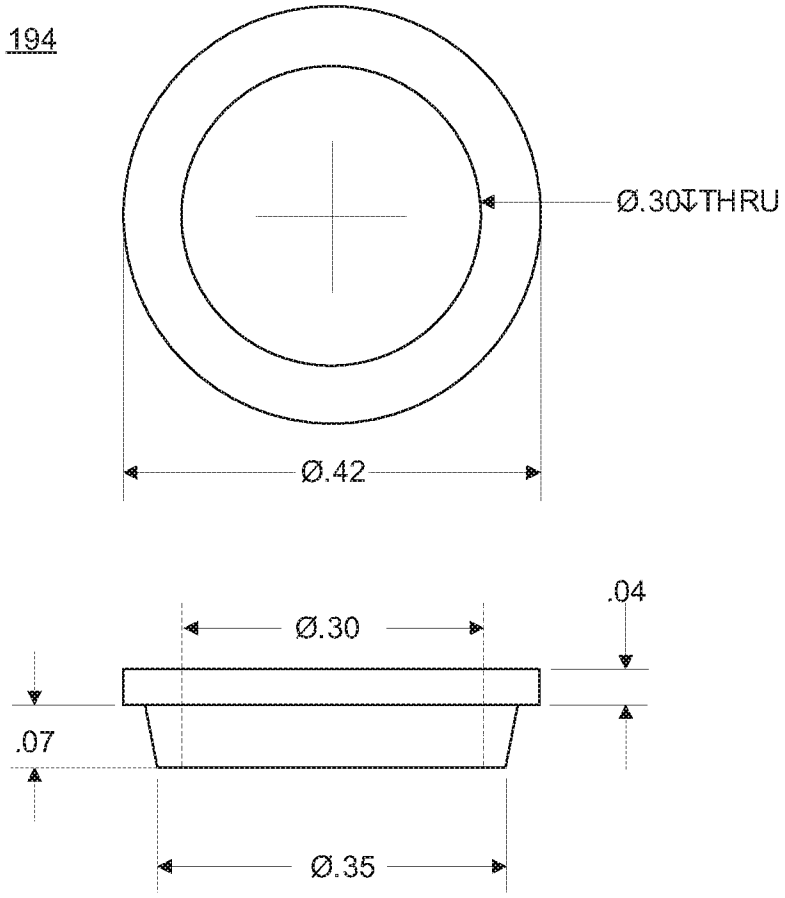
FIG. 15 is a detail view of spring seat seal, in accordance with embodiments of the present invention.

FIG. 15 is a detail view of spring seat seal 194, in accordance with embodiments of the present invention.

Figure 16:
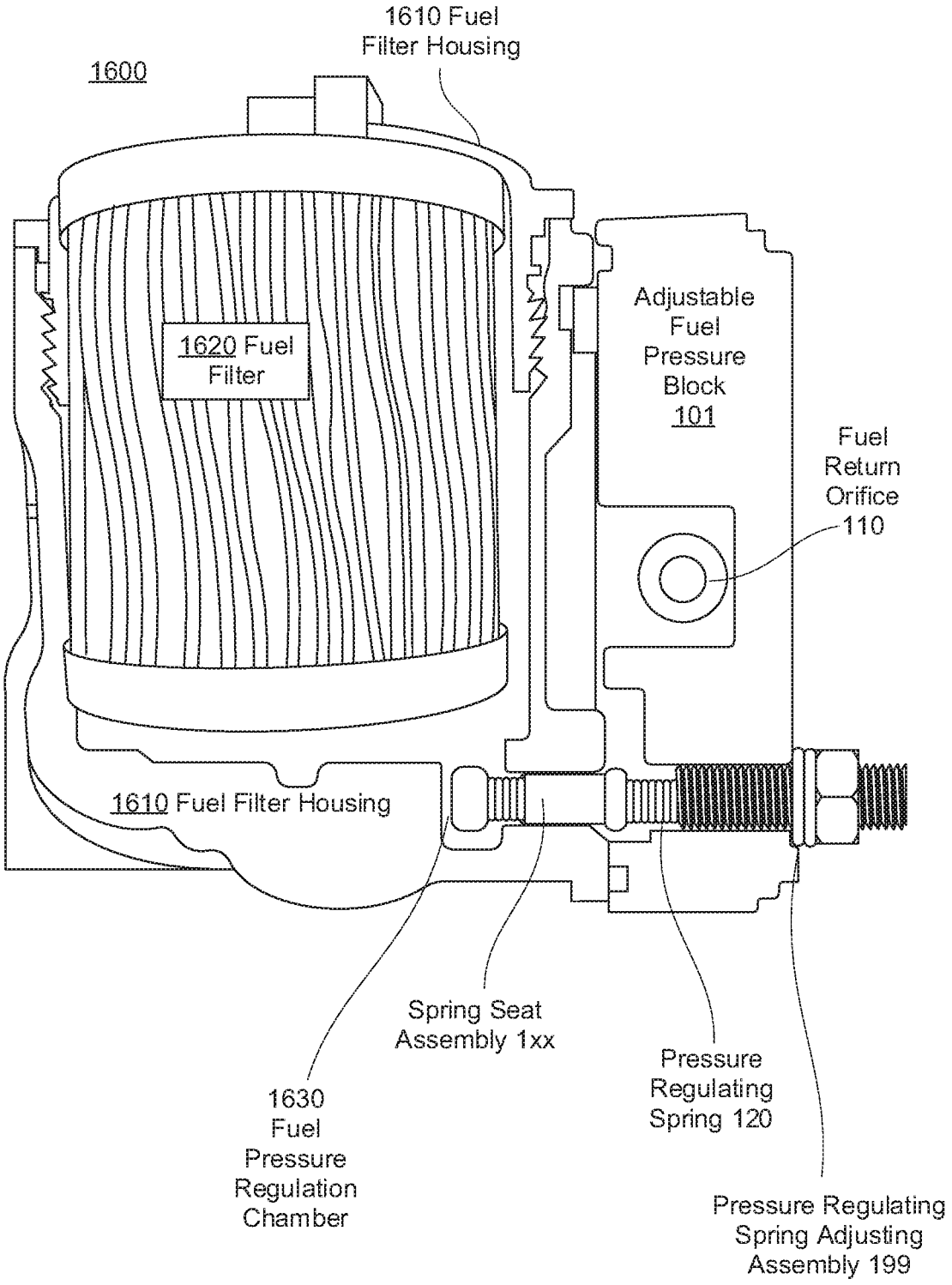
FIG. 16 illustrates an exemplary application of an adjustable fuel pressure module, in accordance with embodiments of the present invention.

FIG. 16 illustrates an exemplary application of an adjustable fuel pressure module 100, in accordance with embodiments of the present invention. The adjustable fuel pressure module 100 may be mounted, e.g., via mounting bolts 180, to a fuel filter housing 1610, comprising a fuel filter 1620. In FIG. 16, the adjustable fuel pressure block 101 and the fuel filter housing 1610 have been sectioned. The remaining elements, e.g., pressure regulating spring adjusting assembly 199, pressure regulating spring 120, spring seat assembly 190, and the fuel filter 1620 are whole. This view of adjustable fuel pressure block 101 corresponds to section A-A of FIG. 2, rotated by 90 degrees.

In operation, fuel enters the fuel filter housing 1610, driven by a fuel pump (not shown). The adjustable fuel pressure module 100 applies a force via the pressure regulating spring 120 to the spring seat assembly 190. When fuel pressure within the fuel filter housing 1610 is at or below a force required to overcome the pressure regulating spring 120 force, the spring seat assembly 190 seals the fuel pressure regulation chamber 1630. No fuel is allowed to enter the adjustable fuel pressure module 100, and all fuel will exit the fuel filter 1620 to the engine.

When fuel pressure within the fuel filter housing 1610 exceeds a force required to overcome the pressure regulating spring 120 force, the spring seat assembly 190 may be displaced to the right in FIG. 16, and unseals the fuel pressure regulation chamber 1630. Some amount of fuel may be allowed to enter the adjustable fuel pressure module 100, as indicated by the white arrows, flowing out of the adjustable fuel pressure module 100 through the fuel return orifice 110 and the threaded fitting 112. The fuel so diverted bypasses the engine and may be returned to the fuel tank.

It is to be appreciated that the force applied to the spring seat assembly 190 by the pressure regulating spring 120 may be adjusted, for example, by changing the length available to the pressure regulating spring 120 by adjusting the pressure regulating spring adjusting assembly 199. Adjusting the force applied to the spring seat assembly 190 will adjust the pressure of fuel delivered to the engine. For example, responsive to a greater force applied to force applied to the spring seat assembly 190, the fuel pressure within the fuel filter housing 1610, and the fuel pressure delivered to the engine will be correspondingly greater. Fuel pressure may be regulated to a range of approximately 60-65 psi, for example.

In this novel manner, fuel pressure may be adjusted for any particular engine, including under various engine operating conditions, and for any of myriad potential engine modifications. For example, a range of performance modifications may require or be enhanced by changes in fuel pressure. Fuel pressure may also be adjusted to accommodate aging effects of the pressure regulating spring 120.

The adjustable fuel pressure block serves at least two different purposes. The adjustability allows the fuel pressure to be dialed into a desired pressure for different applications, for example, performance applications. In addition, over time the spring will experience fatigue and will begin to lose energy. As this happens the adjustability will be able to compensate for the lost energy in the spring.

The adjustable fuel pressure block may be mounted on the fuel filter housing and regulates the fuel pressure. Fuel pressure may be regulated by the force of the spring acting on the brass spring seat, which seals against the fuel filter housing. The greater the force on the spring seat, the higher the pressure in the fuel system, and vice versa. To increase the force on the spring seat, one would tighten the threaded adjustment screw, down through the face of the adjustable fuel pressure block. For example, threaded adjuster 170 may be adjusted, e.g., tightened or loosened, by rotating jam nut 140, and/or by rotating threaded adjuster 170 directly, for example, via a hex socket or Allen key, or other screw-turning system, e.g., slot, Phillips, Pozidriv, square, Robertson, hex head (exterior), Torx, security Torx, tri-wing, torq-set, spanner head, triple square, polydrive, spline drive, double hex, Bristol, pentalobular, or the like.

Fuel flows, from the fuel pump, in through the fuel filter housing and as the pressure exceeds the set pressure value the spring seat will "retract," compressing the spring and allowing fuel to flow past the seat and spring. Fuel will then flow through the adjustable fuel pressure block 101 and out through the threaded fitting 112 on the side of the adjustable fuel pressure module 100. As the pressure normalizes the brass spring seat will seal against the fuel filter housing 1610 and no fuel will flow through the adjustable fuel pressure module 100.

A conventional art fuel pressure regulator, e.g., as supplied by the vehicle manufacturer, is generally formed from a cast metal, and the spring is not adjustable. For example, one end of the spring is constrained by an interior face of the casting. Such a casting process is generally less dimensionally accurate than a machining process. Accordingly, the length of the spring has a greater degree of variation, and thus the cast body leads to an undesirably greater degree of fuel pressure variation among instances of conventional art fuel pressure regulators. In addition, there are other drawbacks to cast parts in this application. For example, the presence of injection ports, mold parting lines, draft, and/or other characteristics of cast parts may interfere with the fit and function of such devices. Machined embodiments in accordance with the present invention do not suffer from such defects.

A conventional art non-adjustable spring will degrade over time, e.g., its spring rate will change with time, and deleteriously decrease fuel pressure. In contrast, embodiments in accordance with the present invention may be adjusted to maintain a desirable fuel pressure.

Figure 17A:
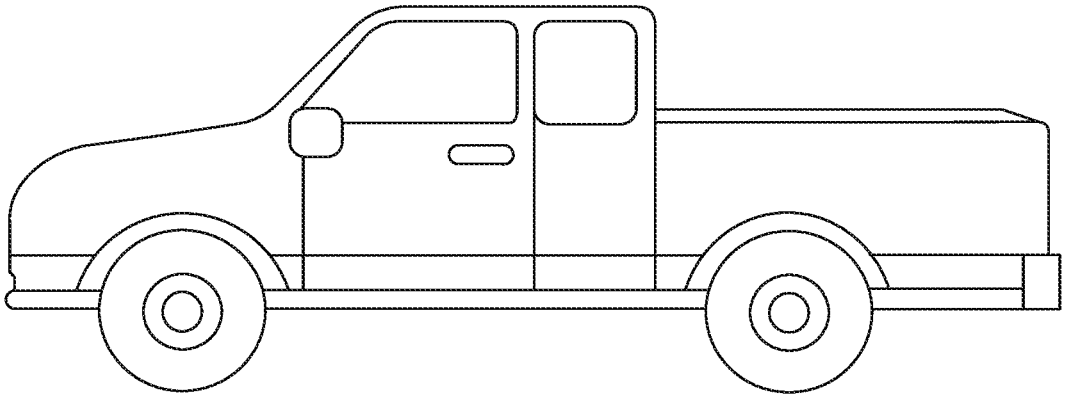
FIG. 17A illustrates an exemplary engine-using apparatus, which may be used as a platform to implement embodiments of the present invention.

FIG. 17A illustrates an exemplary engine-using apparatus 1710, which may be used as a platform to implement embodiments of the present invention. Apparatus 1710 may be a pickup truck, in some embodiments. It is to be appreciated that a wide variety of engine-using apparatuses are well suited to embodiments in accordance with the present invention. For example, embodiments in accordance with the present invention may include motor vehicles, including passenger and freight vehicles, cars and trucks, off-road vehicles, including farm tractors, combines, military vehicles, construction vehicles, above and below-ground mining equipment, and the like. Embodiments in accordance with the present invention may also include boats, for example, including submarines, e.g., diesel-electric submarines and air-independent (AIP) submarines, ships, and aircraft.

Embodiments in accordance with the present invention may further include engine-using apparatuses that are not generally considered to be self mobile, including, for example, engine-powered electrical generation equipment, "gen sets," pumps, including irrigation pumping systems, fire-fighting systems, e.g., fire-fighting "skid" units, pressure washing systems, and the like. All such engine-using apparatuses are envisioned and considered within the scope of embodiments of the present invention.

Figure 17B:
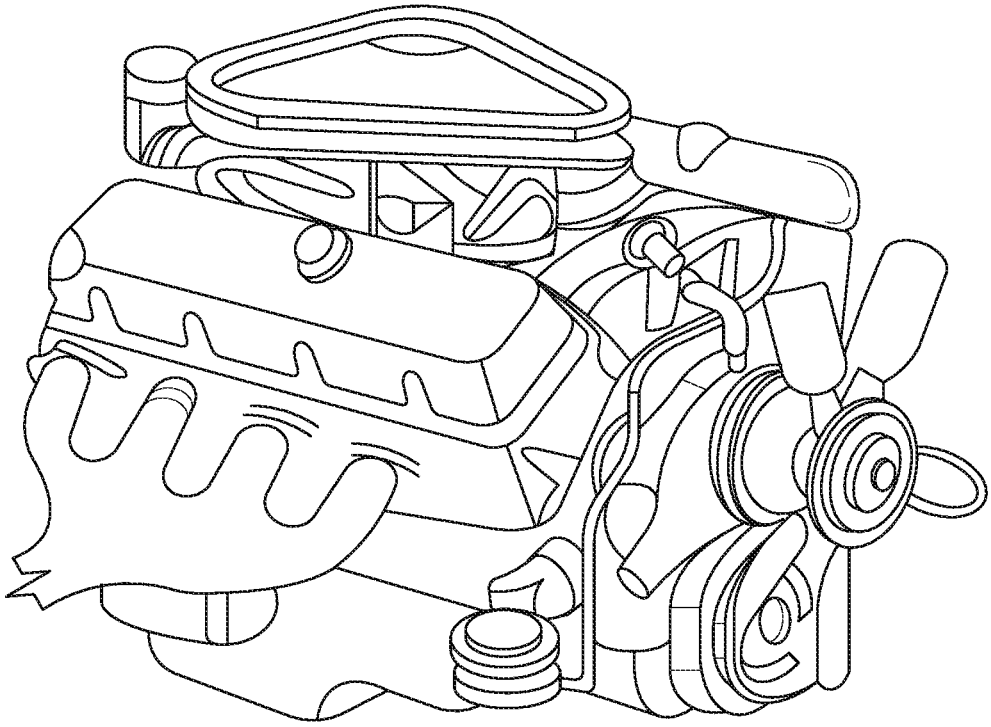
FIG. 17B illustrates an exemplary engine, which may be used as a platform to implement embodiments of the present invention.

FIG. 17B illustrates an exemplary engine 1720, which may be used as a platform to implement embodiments of the present invention. Engine 1720 may be part of engine-using apparatus 1710, as illustrated in FIG. 17A, in some embodiments. Engine 1720 generally converts chemical energy of a liquid, atomized, or gaseous fuel into mechanical energy. For example, an adjustable fuel pressure module, e.g., exemplary adjustable fuel pressure module 100, as illustrated in FIG. 1A, may be part of a fuel delivery system for engine 1720. In some embodiments, exemplary adjustable fuel pressure module 100 may be mounted to engine 1720, and considered a part of an assembly generally known as or referred to as an "engine".

It is to be appreciated that a wide variety of engine types are well suited to embodiments in accordance with the present invention. For example, embodiments in accordance with the present invention may include internal combustion engines. Internal combustion engines may include reciprocating engines, e.g., gasoline or diesel piston engines, rotary, e.g., Wankel, engines, turbine engines, including axial and centrifugal flow turbine engines, and the like. Embodiments in accordance with the present invention may also include external combustion engines, including, for example, boilers, including fire tube and water tube type boilers, Stirling engines, and the like.

Embodiments in accordance with the present invention provide methods and apparatuses for adjustable fuel pressure modules. In addition, embodiments in accordance with the present invention provide methods and apparatuses for adjustable fuel pressure modules that are able to adjust fuel pressure to desirable levels. Further, embodiments in accordance with the present invention provide methods and apparatuses for adjustable fuel pressure modules that are able to adjust fuel pressure to compensate for aging components. Still further, embodiments in accordance with the present invention provide methods and apparatuses for adjustable fuel pressure modules that are compatible and complementary with existing systems and methods of engine fuel pressure regulation.

Various embodiments of the invention are thus described. While the present invention has been described in particular embodiments, it should be appreciated that the invention should not be construed as limited by such embodiments, but rather construed according to the below claims.

What is claimed is:

1. An apparatus for regulating fuel pressure, comprising:

a fuel regulating body, separate from a fuel filter housing, configured to removably mate to said fuel filter housing, wherein said fuel regulating body and said fuel filter housing are configured to mate with one another without deformation of structural material, wherein said fuel regulating body and said fuel filter housing are configured to separate from one another, after mating, without deformation of said structural material, wherein said fuel regulating body and said fuel filter housing are configured to remate with one another, after separation, without deformation of said structural material, and wherein said structural material excludes spring material and gasket material;

a spring seat assembly configured to seal an opening in said fuel filter housing according to a force applied by a pressure regulating spring acting on said spring seat assembly;

a pressure regulating spring adjusting assembly mounted to said fuel regulating body, configured to constrain an adjustable length of said pressure regulating spring, wherein said spring is constrained between said spring seat assembly and said pressure regulating spring adjusting assembly, wherein a force exerted upon said spring seat assembly by said pressure regulating spring corresponds to a desirable fuel pressure, wherein said pressure regulating spring is external to said fuel filter housing, and wherein said spring seat assembly is configured to unseal said opening in said fuel filter housing responsive to a fuel pressure greater than said desirable fuel pressure.

2. The apparatus of claim 1 wherein said fuel regulating body further comprises a fuel return orifice configured to allow fuel that bypasses said spring seat assembly to exit said fuel regulating body.

3. The apparatus of claim 1 wherein said pressure regulating spring adjusting assembly is configured to adjust a length of said pressure regulating spring by a screw action in to and out of said fuel regulating body.

4. The apparatus of claim 1 wherein said fuel regulating body comprises aluminum.

5. The apparatus of claim 1 wherein said fuel regulating body is machined.

6. The apparatus of claim 1 wherein said spring seat assembly comprises brass.

7. The apparatus of claim 1 wherein said pressure regulating spring adjusting assembly comprises a threaded adjuster, a pressure sealing washer, a flat washer and a jam nut.

8. A method of regulating fuel pressure comprising:

sealing an opening in a fuel filter housing according to a force applied by a pressure regulating spring acting from outside of said fuel filter housing on a spring seat assembly;

adjusting said force applied by said pressure regulating spring to establish a desirable fuel pressure by changing a length of said pressure regulating spring by a screw action of a pressure regulating spring adjusting assembly constraining one end of said pressure regulating spring; and unsealing said opening in a fuel filter housing responsive to a fuel pressure within said fuel filter greater than said desirable fuel pressure, wherein said unsealing is configured to direct fuel outside of said fuel filter housing without said fuel flowing through the fuel filter housing subsequent to passing through said opening, wherein said pressure regulating spring is within a fuel regulating body that is separate from said fuel filter housing, wherein said fuel regulating body is configured to removably mate to said fuel filter housing, wherein said fuel regulating body and said fuel filter housing are configured to mate with one another without deformation of structural material, wherein said fuel regulating body and said fuel filter housing are configured to separate from one another, after mating, without deformation of said structural material, wherein said fuel regulating body and said fuel filter housing are configured to remate with one another, after separation, without deformation of said structural material, and wherein said structural material excludes a spring material and gasket material.

9. The method of claim 8 wherein said unsealing is configured to allow fuel to be returned to a fuel tank.

10. The method of claim 8 wherein said adjusting comprises turning a hex key in a hex socket of the threaded adjuster.

11. The method of claim 8 wherein said threaded adjuster comprises a cylindrical void for accommodating said pressure regulating spring.

12. The method of claim 11 wherein said cylindrical void is closed on one end and configured to retain said pressure regulating spring.

13. The method of claim 8 wherein said sealing allows fuel to enter an engine.

14. The method of claim 8 wherein said adjusting is configured to compensate for changes in a spring constant of said pressure regulating spring.

15. A vehicle, comprising:

an engine for converting chemical energy of a fuel into mechanical energy to move the vehicle;

an apparatus for regulating fuel pressure for the engine, the apparatus comprising:

a fuel regulating body, separate from a fuel filter housing, configured to removably bolt to said fuel filter housing;

wherein said fuel regulating body and said fuel filter housing are configured to mate with one another without deformation of structural material, wherein said fuel regulating body and said fuel filter housing are configured to separate from one another, after mating, without deformation of said structural material, wherein said fuel regulating body and said fuel filter housing are configured to remate with one another, after separation, without deformation of said structural material, and wherein said structural material excludes spring material and gasket material;

a spring seat assembly configured to seal an opening in said fuel filter housing according to a force applied by a pressure regulating spring acting on said spring seat assembly, wherein said opening is from an inside of said fuel filter housing to an outside of said fuel filter housing;

a pressure regulating spring adjusting assembly mounted to said fuel regulating body, configured to constrain an adjustable length of said pressure regulating spring, wherein said spring is constrained between said spring seat assembly and said pressure regulating spring adjusting assembly, wherein a force exerted upon said spring seat assembly by said pressure regulating spring corresponds to a desirable fuel pressure, and wherein said spring seat assembly is configured to unseal said opening in said fuel filter housing responsive to a fuel pressure greater than said desirable fuel pressure.

16. The vehicle of claim 15 wherein the engine comprises a diesel engine.

17. The vehicle of claim 15 comprising a pickup truck.

18. The vehicle of claim 15 wherein said fuel regulating body further comprises a fuel return orifice configured to allow fuel that bypasses said spring seat assembly to exit said fuel regulating body.

19. The vehicle of claim 18 wherein said pressure regulating spring adjusting assembly is configured to adjust a length of said pressure regulating spring by a screw action in to and out of said fuel regulating body.

20. The vehicle of claim 18 wherein the apparatus for regulating fuel pressure comprises machined aluminum.

* * * * *